US012135182B2

(12) United States Patent
Kroyer

(10) Patent No.: US 12,135,182 B2
(45) Date of Patent: Nov. 5, 2024

(54) BREECH FOR A PISTOL

(71) Applicant: GLOCK TECHNOLOGY GMBH, Ferlach (AT)

(72) Inventor: Josef Kroyer, Zemendorf (AT)

(73) Assignee: GLOCK TECHNOLOGY GMVH, Ferlach (AT)

( * ) Notice: Subject to any disclaimer, the term of this patent is extended or adjusted under 35 U.S.C. 154(b) by 39 days.

(21) Appl. No.: 17/756,171

(22) PCT Filed: Nov. 13, 2020

(86) PCT No.: PCT/EP2020/082013

§ 371 (c)(1),
(2) Date: May 18, 2022

(87) PCT Pub. No.: WO2021/099218

PCT Pub. Date: May 27, 2021

(65) Prior Publication Data

US 2022/0412678 A1 Dec. 29, 2022

(30) Foreign Application Priority Data

Nov. 22, 2019 (EP) ..... 19210954

(51) Int. Cl.
*F41A 3/66* (2006.01)
*F41A 21/48* (2006.01)

(52) U.S. Cl.
CPC ..... *F41A 3/66* (2013.01); *F41A 21/488* (2013.01)

(58) Field of Classification Search
CPC ..... F41A 21/488
See application file for complete search history.

(56) References Cited

U.S. PATENT DOCUMENTS 4,563,937 A * 1/1986 White ..... F41A 21/484 89/185
4,594,935 A * 6/1986 Smith ..... F41A 21/484 89/138
4,619,184 A * 10/1986 Shalev ..... F41A 17/56 89/185
4,907,362 A * 3/1990 Hobbie ..... F41A 9/55 42/49.02
5,094,169 A * 3/1992 Evitts ..... F42B 5/26 102/464
5,983,773 A * 11/1999 Dionne ..... F41A 11/02 89/196

(Continued)

FOREIGN PATENT DOCUMENTS

DE 102006031657 A1 1/2008
EP 174901 A2 3/1986

*Primary Examiner* — Bret Hayes
(74) *Attorney, Agent, or Firm* — Raven Patents, LLC; Anton E. Skaugset

(57) ABSTRACT

A breech for a pistol including a barrel, which includes at least one barrel block and one chamber, as well as a slide and a breech guide, which is designed to move on a guide rail of a frame of the pistol and on which a socket having a breech face is formed. In order to increase the mechanical stability, the barrel block includes at least one recess on each side, which interacts with centering rails that are provided on the inside of the breech guide and are formed to be complementary to the recesses in terms of form and function.

15 Claims, 8 Drawing Sheets

(56) References Cited

U.S. PATENT DOCUMENTS

| | | | | |
|---|---|---|---|---|
| 6,276,252 | B1 * | 8/2001 | Dionne | F41A 3/86 89/14.05 |
| 8,528,243 | B1 | 9/2013 | Glock | |
| 8,832,983 | B1 | 9/2014 | Wolf | |
| 11,022,394 | B1 * | 6/2021 | Kedairy | F41A 21/12 |
| 2001/0022131 | A1 * | 9/2001 | Moczijdlower | F41A 5/34 89/155 |
| 2016/0363406 | A1 * | 12/2016 | Wiesblott | F41A 21/28 |
| 2017/0268843 | A1 * | 9/2017 | Heizer | F41A 19/45 |
| 2022/0252369 | A1 * | 8/2022 | Geissle | F41A 21/12 |

* cited by examiner

BREECH FOR A PISTOL

TECHNICAL FIELD

The present disclosure relates to firearms, in particular to a breech for a pistol, and more particularly to a breech for small-caliber pistols, training weapons or sport weapons.

BACKGROUND

EP 174901 A2 discloses a conversion kit from a not specifically disclosed automatic pistol to a single-shot pistol with fixed barrel and no functional magazine. The purpose of the kit is to enhance the accuracy of shooting. The main concern of this document is the disclosure of a specific safety arrangement.

According to the prior art, a "breech" of a pistol includes all the components that are provided for feeding and positioning a cartridge and for pulling out a casing.

Training pistols are generally pistols of which the outer dimensions and/or handling is as similar as possible to that of a "real" pistol. However, these weapons often have a different caliber, which is frequently lower impulse and/or smaller than that of the actual pistol. Likewise, rubber bullets, blanks, or color-marking ammunition are often used, which require a lower load. Pistols of this kind are a preferred field of application for the breeches of the present disclosure, as well as their use as sport weapons.

Concepts for training pistols are known from the past which, similarly to the "real" pistol, comprise a break-action barrel (also known as a "Browning system") and a blowback. This relates inter alia to pistols which can be used for color-marking cartridges, for example. However, with the comparatively less loaded cartridges for the color-marking ammunition, the relatively heavy slide of a "normal, real weapon" cannot be moved backwards sufficiently in some circumstances in order to automatically complete the loading process. To solve this problem, U.S. Pat. No. 8,528,243 B1 proposes a polymer-metal composite slide which, inter alia, comprises a bridge for stabilizing the composite slide.

The use of polymers in the region of the breech of a pistol, in particular for manufacturing the slide or at least parts thereof, is also proposed in DE 10 2 006031 657 A1, inter alia. For sport shooters or authorities, training with a break-action weapon having a "larger caliber", e.g. a 9 mm Luger and above, is often too expensive, which is why attempts are often made to switch the training to more cost-effective alternative ammunition, such as 0.22 LRs. In addition, for sport shooters who do not use "larger-caliber" pistols, small-caliber pistols are a cost-effective training weapon and/or competition weapon. In these cases too, there is the requirement for a light slide and/or breech by means of a lower load of the low-caliber pistols, which is why, in construction, a break-action system having a blowback is often avoided and instead, a rigid barrel having a blowback and a lighter slide is used.

However, shooters will still not want to forgo the required precision in low-caliber weapons. In the context of the present disclosure, break-action barrels are understood to be those barrels which are arranged so as to be movable within limits relative to the frame of the weapon, e.g. by means of a barrel hook on the locking block, and can tilt downwards during the loading process. By contrast, in the context of the present disclosure, a rigid barrel is understood such that the barrel of the pistol is not moved relative to the locking block during the loading process. Here, the loading process substantially takes place by means of a linear movement of the slide along the barrel axis. Here, the "rigid" barrel can be supported on one or more support points on the frame provided for this purpose, or on a locking block provided for this purpose, and is thus not rigidly connected to the frame, i.e. by means of screws, for example.

This type of mount for rigid barrels is therefore a challenge, since, first of all, it needs to be simple to disassemble the pistol and, despite a comparatively low load, high forces still act on the barrel and thus the mount thereof. Second, the barrel needs to remain as rigid as possible relative to the frame when installed, e.g. in order to prevent inaccurate orientation in the horizontal and/or vertical position. Nevertheless, the muzzle of said barrel needs to be able to "freely oscillate", in order to prevent, inter alia, any warping of the barrel in the event of thermal expansion.

An additional requirement, in particular from authorities, is that a training weapon having a smaller caliber is as similar as possible to handle as a service weapon having a larger caliber. Since training weapons can also have a high round count, it is desirable for the weapon to be simple to disassemble and to be manufactured so as to be as durable as possible.

The present disclosure then addresses the problem of providing a breech for a pistol, in particular small-caliber pistols and/or training pistols which have high precision. Furthermore, another problem addressed is to transfer the handling of a "real" pistol having a break-action system to the handling of a small-caliber pistol and/or a training pistol having a rigid barrel as identically as possible. Moreover, the problem addressed by the disclosure is to provide, in one embodiment, a breech system for pistols having a rigid barrel that is as durable and as simple to disassemble as possible.

SUMMARY

These problems are solved according to the present disclosure by means of a breech for a pistol having a frame and a central weapon place, and that is suitable for use with a magazine. The disclosed breech includes a barrel having at least one barrel block and at least one chamber, where the at least one barrel block includes at least one recess on each side of the barrel block, and a slide having a breech guide designed to move on a guide rail of the frame of the pistol, including a socket having a breech face formed on the slide. The breech guide additionally includes centering rails on the inside of the breech guide, the centering rails being complementary to the recesses of the barrel block in terms of form and function.

In another aspect, the present disclosure is directed to a pistol, where the pistol has a central weapon plane and is suitable for use with a magazine. The pistol of the disclosure can include a frame, a barrel having at least one barrel block and at least one chamber, where the at least one barrel block includes at least one recess on each side of the barrel block, and a slide having a breech guide designed to move on a guide rail of the frame, including a socket having a breech face formed on the slide. The breech guide of the slide includes centering rails on the inside of the breech guide, the centering rails being complementary to the recesses of the barrel block in terms of form and function.

BRIEF DESCRIPTION OF THE DRAWINGS

The breech and pistol of the present disclosure will be explained in greater detail with reference to the drawings, in which.

DETAILED DESCRIPTION

Figure 1:
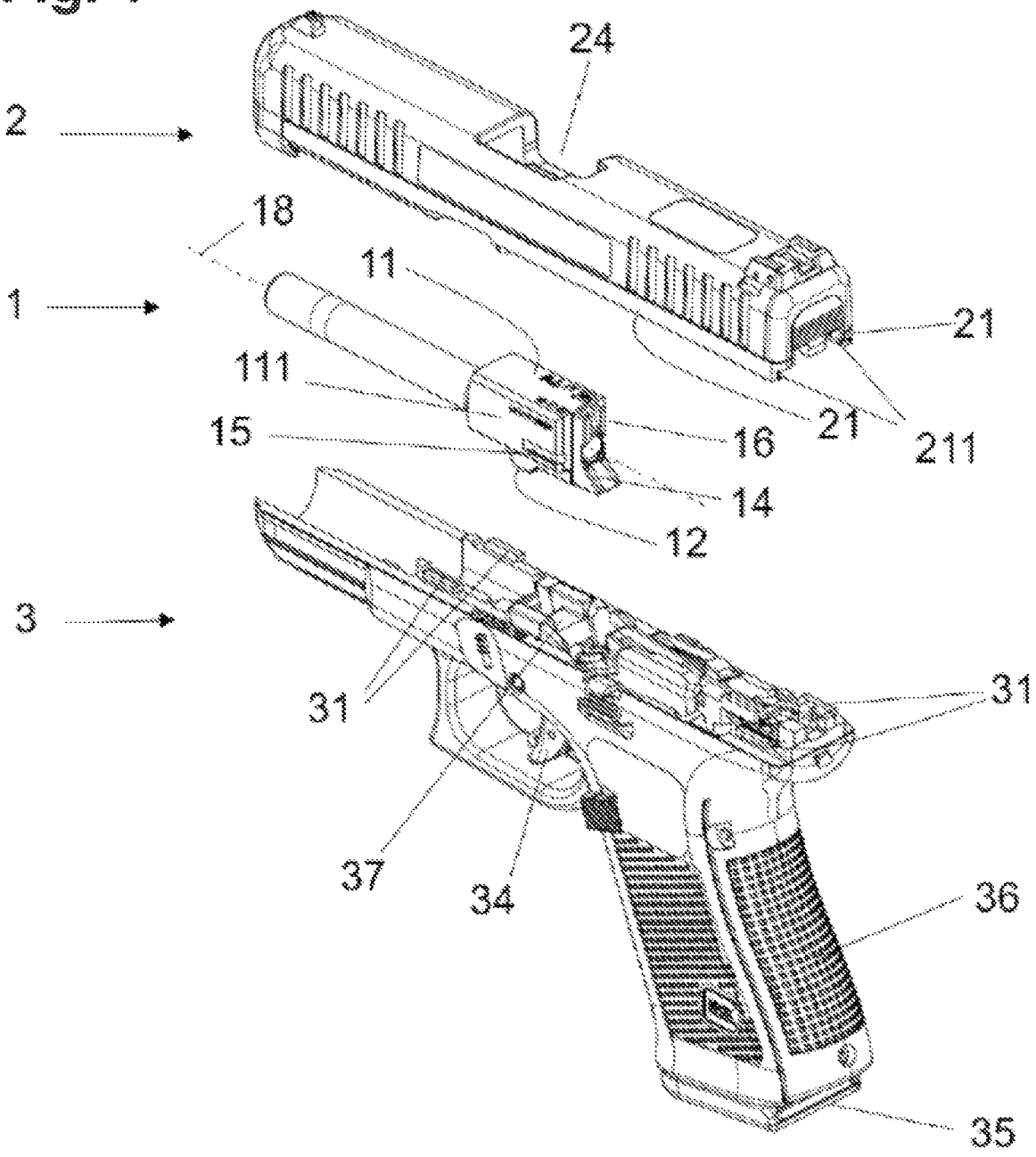
FIG. 1 is a simplified exploded view of a training pistol.

The present disclosure is directed to a breech for a pistol, where the pistol includes at least one barrel including a barrel block, and a slide including a breech guide, where the breech guide is designed to interact with a guide rail formed on the frame of the pistol. The barrel is a rigid barrel which does not move relative to the frame during the loading process. The breech guide includes a socket having a breech face and acts as a slide element or guide element of the slide in the longitudinal direction of the pistol during the movement of the breech. In one embodiment, centering rails are formed on the inside of the breech guide in front of the socket in the direction of fire and interact in a centering manner with recesses provided on the side of the barrel block during the closing movement in the horizontal and/or vertical direction, relative to the barrel axis.

The centering rails are formed on the inside of the breech guide so as to be complementary to the recesses in the barrel block in terms of form and function. By laterally and/or vertically mounting the barrel on the centering rails by means of the recesses, a first support or contact pairing is formed, which facilitates the repeatable orientation of the barrel. Despite the use of small-caliber ammunition, usually with rimfire, and the rigid barrel, the handling of the pistol is almost identical to the handling of pistols that use centerfire cartridges and have a break action. Subsequently, the form-complementary centering rails and recesses can relieve pressure on the guiding grooves and the guide rail, and this increases the durability of the components.

According to the present disclosure, the introduction of force during discharge and during the locking process can take place in a relatively linear manner along said centering elements, and this facilitates a reduction in a tilting moment about the chamber.

Furthermore, some preferred embodiments are described in the following which describe additional second and/or third contact pairings and can additionally solve the above-mentioned problem and can be applied in isolation or in combination.

In the context of the present disclosure, reference is made to small-caliber pistols when the caliber is .380 auto and lower, in particular .22 caliber. Specifically, the 0.22 LR caliber, which is highly suitable for sport and training purposes, is likewise included. Small-caliber cartridges are often designed as rimfire cartridges, which require an accordingly formed chamber and a cartridge extractor corresponding to the cartridge rim. It should be noted that the embodiments according to the present disclosure can also be relatively easily adapted for use at other calibers and/or in centerfire cartridges by a person skilled in the art with knowledge of the disclosure.

Further components of a pistol, such as the trigger mechanism, are not described in greater detail in the context of this disclosure, since a person skilled in the art can relatively easily make modifications on the basis of their knowledge in the art, depending on the cartridge type.

In the following, the terms left, right, above, below, front, and rear always relate to the shooter's view in the direction of fire of the firearm when it is being held ready to fire. The weapon has a central weapon plane, extending through the barrel axis and being vertically oriented, which cum grano sails forms a plane of symmetry.

FIG. 1 shows the main structural components of a pistol comprising a barrel 1, having a barrel axis 18, a slide 2, a frame 3, a trigger 34, a magazine 35, and a grip 36. The barrel 1 comprises a barrel block 11, on which a cartridge feed ramp 14 is formed, on the underside of which a barrel hook 12 is formed, and on the rear of which contact bars 16 are formed.

Figure 3:
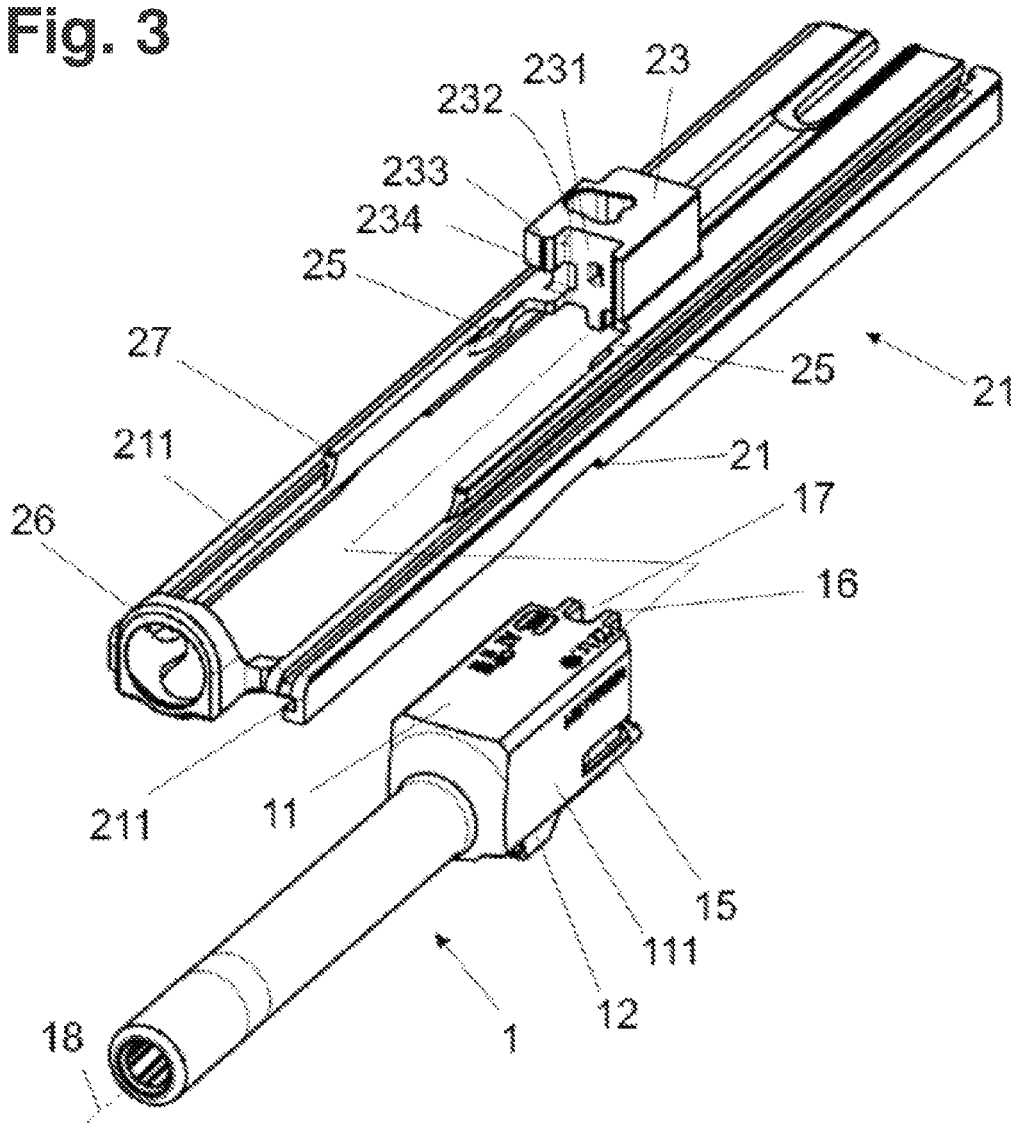
FIG. 3 is an oblique front view of the breech guide and barrel of the training pistol of FIG. 1.
Figure 7A:
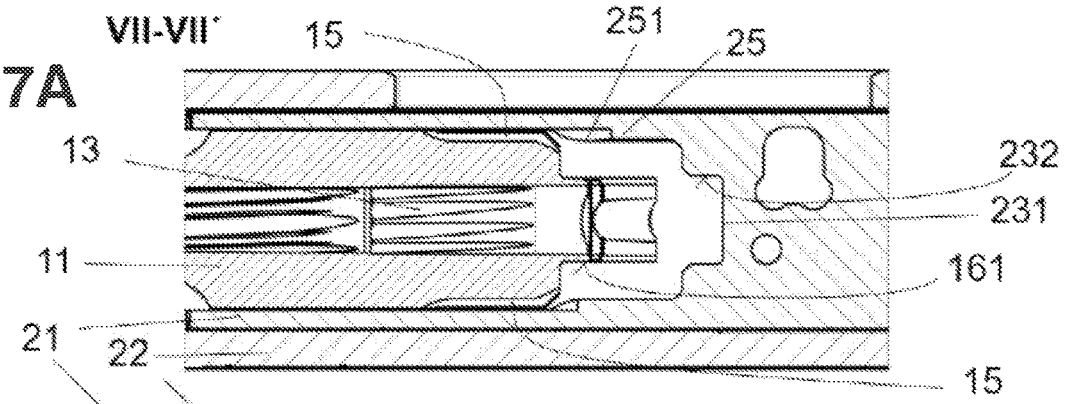
Figure 7B:
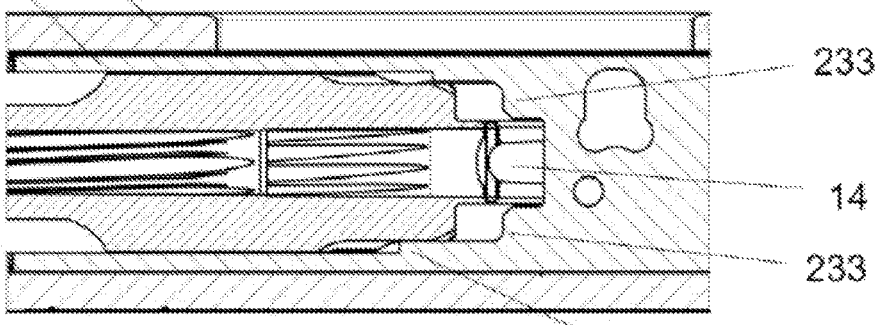

At least one elongate recess 15 that is in parallel with the barrel axis 18 and extends from the rear end of the barrel block 11 in the direction of fire, i.e. forwards, is formed on each of the two block sidewalls 111 of the barrel block 11 that are on the left and the right in the direction of fire. As shown, the barrel 1 is preferably formed in one piece with the barrel block 11, the barrel hook 12 and a chamber 13 (FIGS. 4 and 7), but may also be formed in multiple parts. According to the present disclosure, for weight-saving purposes, the slide 2 comprises a breech guide 21 and at least the slide frame 22, Other components, which are not explained here in greater detail, such as a firing pin unit or a recoil spring unit, may be arranged on or within the slide 2, as is known to a person skilled in the art. An ejection window 24 and the breech guide 21 together with the guiding grooves 211 arranged on either side are e.g. shown in FIG. 1 and are particularly clearly visible when FIGS. 3 and 8 are viewed together. The breech guide 21 can be integrated in the slide 2, i.e. may be formed in one piece therewith or may be in a multiple-part configuration that can be rigidly connected to the slide 2 or connected thereto such that it can be disassembled. The slide frame 22 is preferably made of plastics material and may also be molded onto the breech guide 21, for example. The slide frame 22 is preferably connected to the breech guide 21 by means of the mounting rails 27 shown in FIGS. 3, 4 and 8. These mounting rails 27 are formed on the upper face of the breech guide 21 at least over some of the length and particularly preferably have a substantially L-shaped profile. As a result, the breech guide 21 can e.g. also be connected to the slide frame 22 by said components being slid into one another.

As can also be seen from FIG. 1, the frame 3 comprising the trigger 34, the grip 36, and the magazine 35 comprises, in the upper region, at least one guiding surface 31 on either side, which is formed to be complementary to guiding grooves 211 (FIG. 4) of the breech guide 21 in terms of form and function. In interaction with the guiding grooves 211, the guiding surfaces 31 serve to provide the guided forward and backward movement of the slide 2 or the breech guide 21 and are known to a person skilled in the art.

Figure 2A:
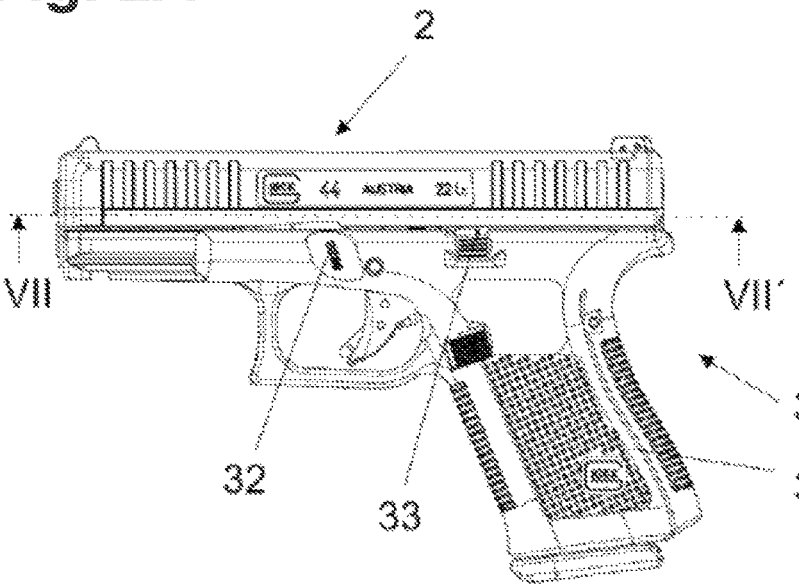
FIGS. 2A-2C are three different normal projections of a training pistol.
Figure 2B:
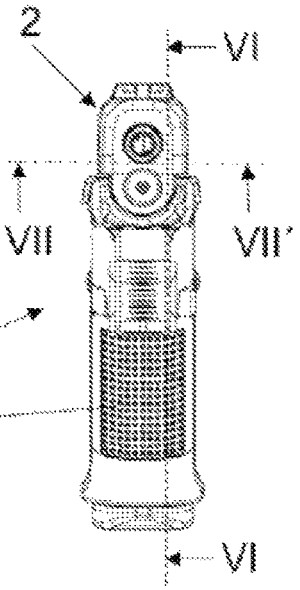
Figure 2C:
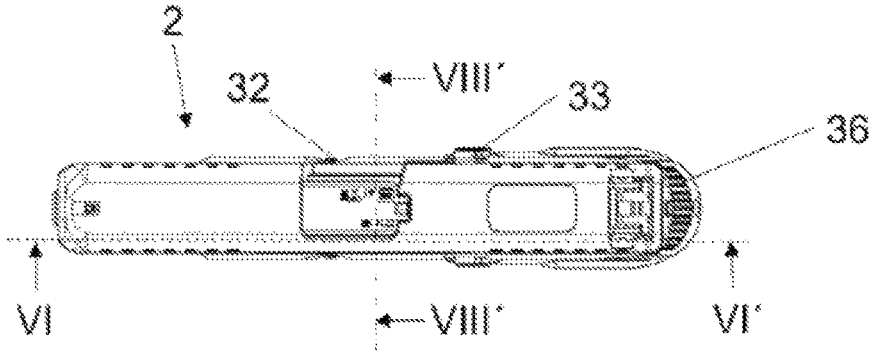
Figure 6A:
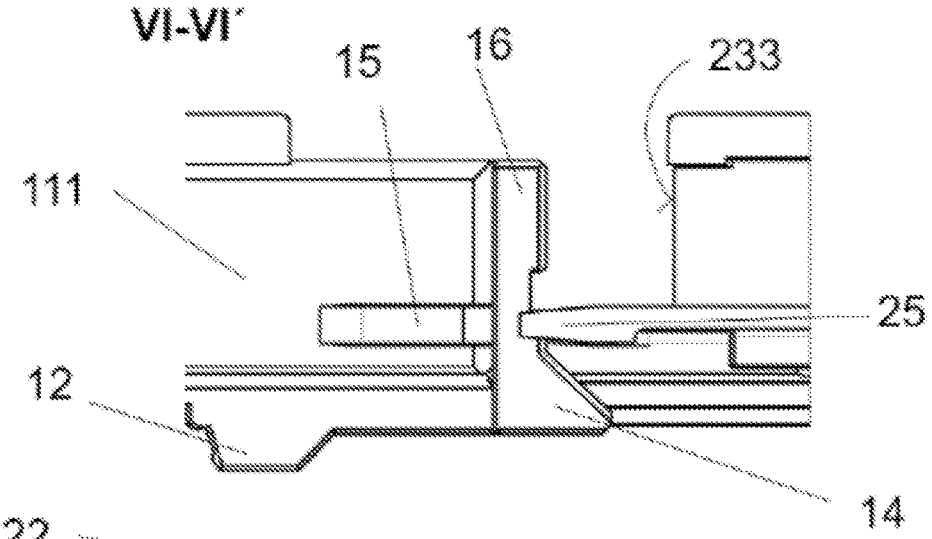
Figure 6B:
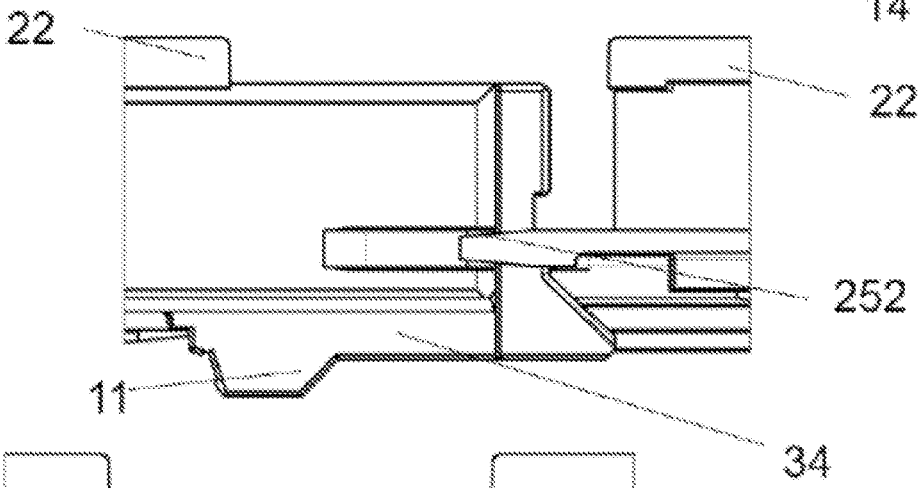

FIGS. 2A-2C are normal projections of a pistol according to the present disclosure when assembled. The line VI-VI defines the sectional plane for the views in FIGS. 6A-6C; the line VII-VII defines the sectional plane for the views in FIGS. 7A-7C; the line VIII-VIII defines the sectional plane and the viewing direction for the view in FIG. 8.

As can be seen from FIGS. 2A-2C, the small-caliber pistol corresponds externally to a larger-caliber pistol, such as the known GLOCK 17, and is very similar to this pistol in appearance. The pistol shown according to the present disclosure thus also comprises a slide stop lever 33 that protrudes laterally on either side of the frame 3, and likewise comprises a disassembly lever 32 that can be actuated on either side and, when it is actuated during the disassembly process, releases the slide 2, in this case with the breech guide 21 fastened thereto, in the direction of fire. The mode of action of these two levers (disassembly lever 32, slide stop lever 33) is known to a person skilled in the art and only needs to be explained in order to describe the identical mode of action in a completely different breech construction using a rigid barrel.

Figure 4:
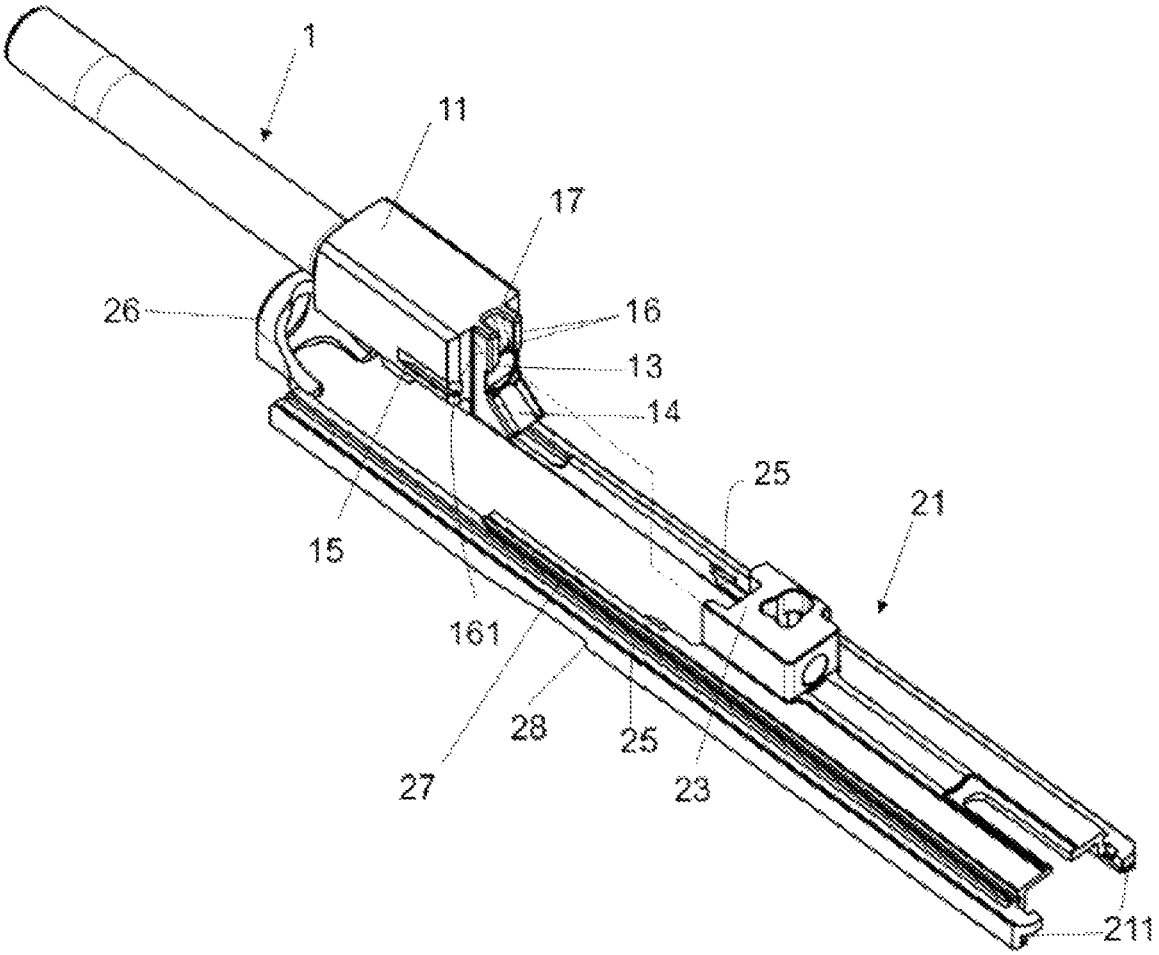
FIG. 4 is a rear view from above of the breech guide and barrel of the training pistol of FIG. 1.

FIG. 3 is an oblique front view of the breech guide 21 and the barrel 1 and FIG. 4 is an oblique rear view thereof. For the sake of improved clarity, the slide 2 is not shown. An elongate recess 15 extending in parallel with the barrel axis 18 is formed on the sidewall 111 of the barrel block 11 that is on the left in the direction of fire and is visible in FIG. 3, A recess 15 extending in parallel with the barrel axis 18 is likewise located on the right-hand sidewall 111, which is not visible, and faces away from the field of view. This recess is symmetrically opposite the left-hand recess relative to the central weapon plane.

The feed ramp 14 is located at the rear end of the barrel block 11, via which ramp a cartridge can slide into the chamber 13, which is located slightly above the magazine 35 in the barrel direction, when this cartridge is taken from the magazine. Contact bars 16 are formed in the region of the chamber 13, i.e. to the side of and/or above said chamber, which bars are interrupted by an indication recess 17 in the embodiment shown. The contact bars 16, which are formed to the side and/or above in the direction of the breech face 231, are clearly visible in FIGS. 4-6. They have side surfaces 161 in the transverse direction that extend in parallel with the central weapon plane. The contact bars 16 serve to support the barrel block 11 at the rear when the breech is closed, i.e, when the slide 2 is in the forward position, against the breech face 231, as is also clear when viewing FIGS. 6A-6C together.

Figure 7C:
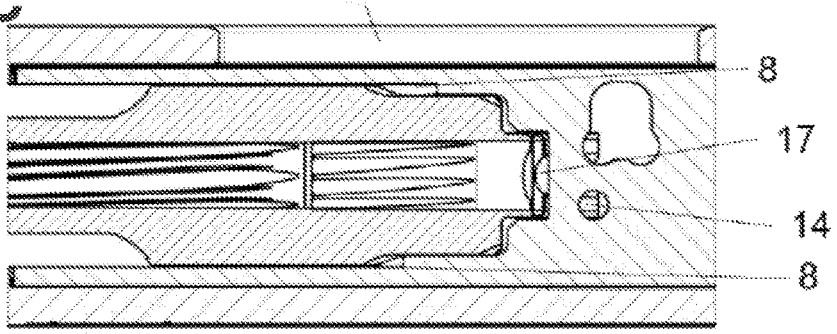
Figure 8:
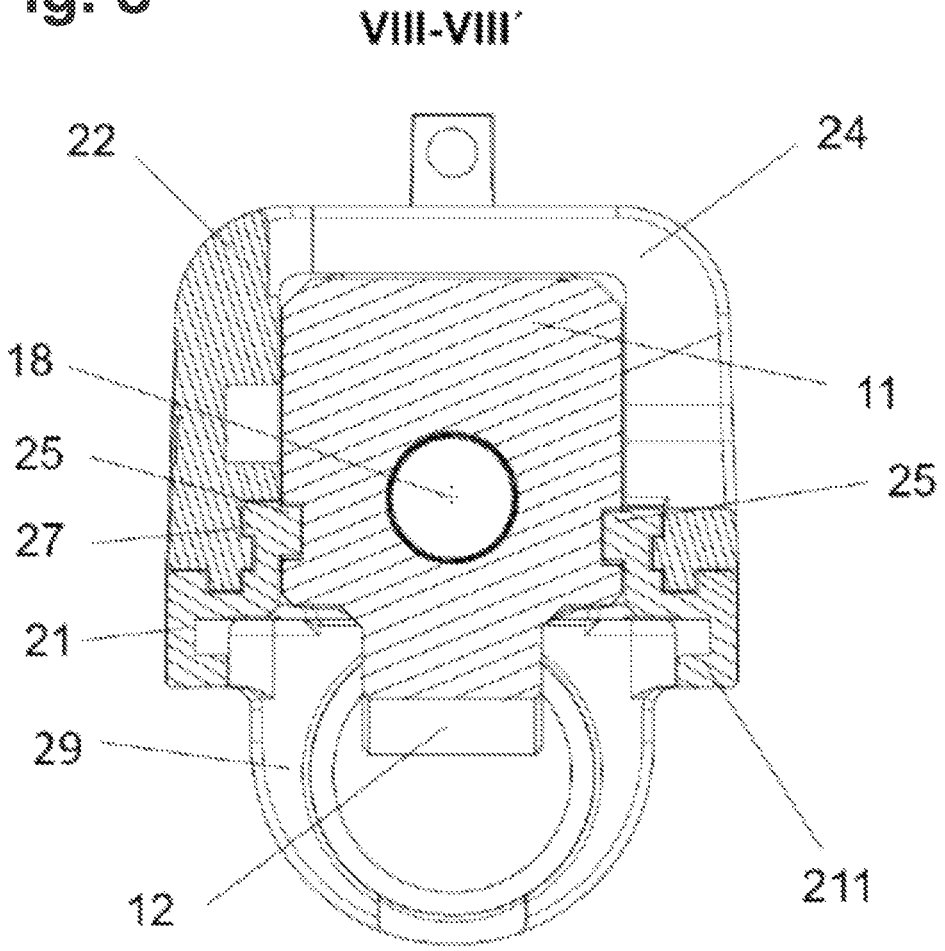
FIG. 8 is a cross section through the breech along line VIII-VIII of FIG. 2C.

FIG. 3 and in particular FIG. 7C show the indication recess 17, which forms a kind of depression in the two contact bars 16 in the barrel direction and preferably extends as an oblique surface, normal to the central weapon plane and from the top/forwards downwards/to the rear. As a result, when the breech is closed a kind of "loaded-chamber window" is formed from above in the direction of the chamber 13 or feed ramp 14 and can assume the function of a loaded-chamber indicator, since the cartridge rim may be visible, the shooter may be able to see whether there is a cartridge in the chamber 13 when the breech is closed.

It is also very clearly visible in FIGS. 3 and 4 that the guiding grooves 211 are located on the breech guide 21 in the lower region on the two longitudinal sides. Said grooves extend substantially from the front to the rear end of the breech guide 21. The guiding grooves 211 are designed so as to be complementary to the guide rails 31 of the frame 3 in terms of form and function. When assembled, the guide rails 31 engage in the guiding grooves 211 and facilitate the sliding, back and forth movement of the breech guide 21 together with the slide 2 relative to the frame 3. A slide stop 28 interrupts the guiding groove 211 and, when the breech is open, allows the slide 2 to latch onto the slide stop lever 33 in the rear position, as can be carried out, for example, automatically by means of the follower when the magazine 35 is empty or also manually in a manner known per se. This is also particularly clear when viewed together with FIG. 5.

Figure 5:
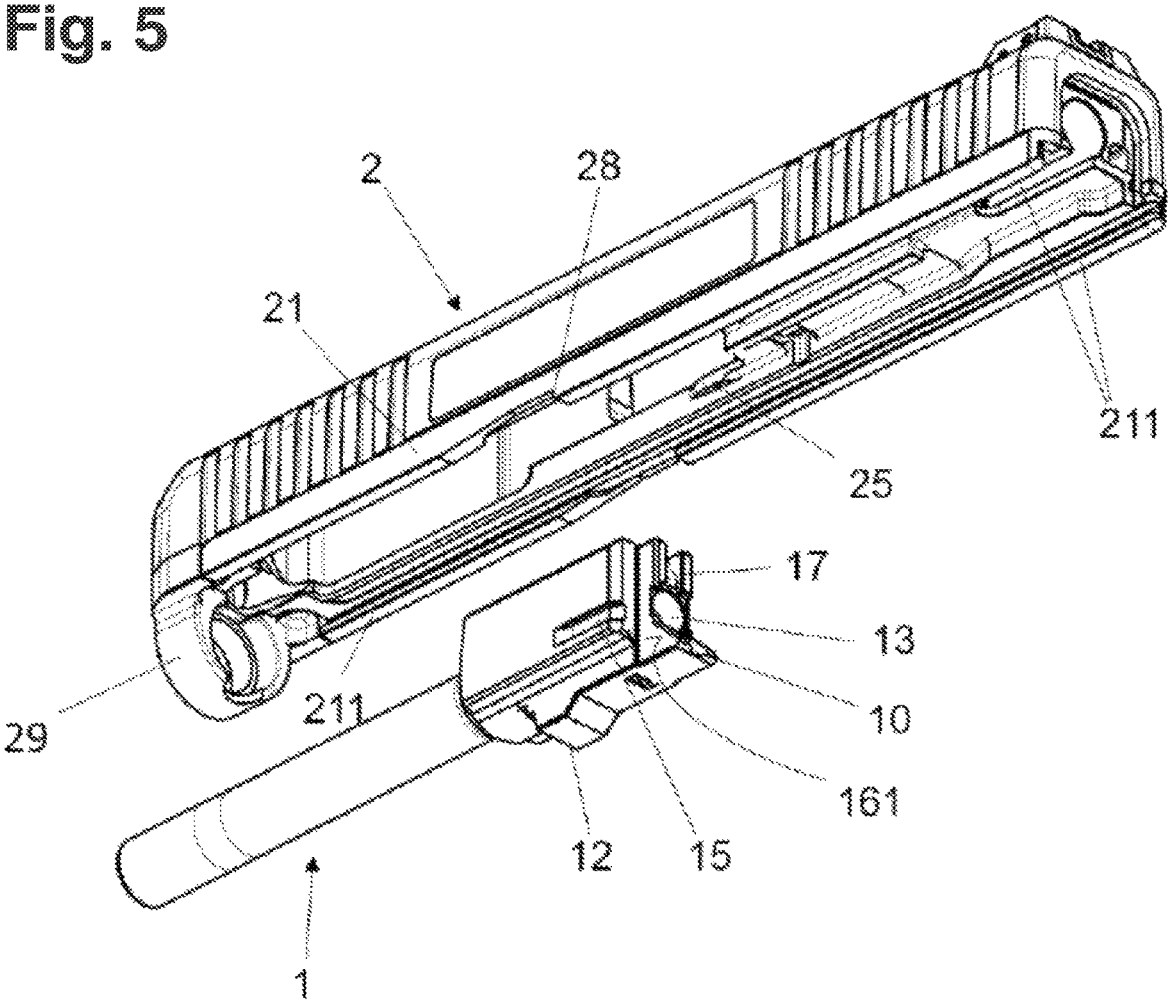
FIG. 5 is an oblique view from below of the breech together with the breech guide and barrel of the training pistol of FIG. 1, FIGS. 6A-6C are side views of the movement sequence during the closing process along line VI-VI of FIG. 2C, FIGS. 7A-7C are longitudinal sections of the movement sequence during the closing process, corresponding to FIGS. 6A-6C, along line VII-VII.

As shown in FIG. 3 in particular, the breech guide 21 comprises an integrally formed socket 23, The one-piece construction allows for high strength and torsion-resistant movement of the breech guide 21 relative to the frame 3 once the cartridge is supported on the breech face 231 after discharge. The breech face 231, which is formed to be normal to the barrel axis 18, comprises an outlet opening for the firing pin, as shown in FIG. 5. Furthermore, one or more socket protrusions 233, which project beyond the plane of the breech face in the direction of fire, are formed on the socket 23 at the sides of the breech face 231.

The protrusion 233 on the side of the weapon that has an ejection window 24 for the casing has, as is shown and preferred, a surface which is vertical but is oblique relative to the barrel axis 18, which makes it easier to eject the casing.

According to the present disclosure, at least one elongate, inwardly projecting centering rail 25 that is oriented in parallel with the barrel axis 18 is formed so as to be symmetrical to the central weapon plane, when viewed in the direction of fire, on each of the two longitudinal sides of the breech guide 21. The centering rails 25 are designed to be complementary to the respective centering recesses 15 in the barrel block 11 in terms of form. In this way, during the locking process, the barrel 1 is horizontally and/or vertically supported on the breech guide 21 via the barrel block 11. The centering rails 25 can thus support the barrel block 11 on their own or in addition to said block resting on the locking block 37. The barrel 1 is thus also repeatably oriented relative to the frame 3 by this measure and can oscillate freely, since contact with the barrel opening 26 is no longer necessary.

The design according to the present disclosure and the interaction of the centering rails 25 and centering recesses 15 can thus solve the central problem mentioned at the outset and contribute to increased precision and repeatability during discharge. Moreover, despite using small-caliber ammunition and a rigid barrel, the pistol can be handled almost identically to the usual use of centerfire cartridges and a break action. Subsequently, the form-complementary centering rails 25 and centering recesses 15 relieve the pressure on the guiding grooves 211 and the guide rail 31, since the introduction of force during discharge and during the locking process can take place in a relatively linear manner along said centering elements. This is advantageous for the service life of the components.

Accordingly, one of ordinary skill in the art having the benefit and knowledge of the present disclosure would appreciate that more than one recess 15 by be formed on each side 111 of the barrel block 11, and that the same applies to the corresponding centering rails 25 on the breech guide 21.

It has proven advantageous for the recesses 15 to be positioned symmetrically to the central weapon plane and thus at the same level in the horizontal position.

If only one recess 15 is formed on each side of the barrel block 11, it is advantageous for the recesses 15 or centering rails 25 to be arranged at the level of the barrel axis 18. In this way, a reduction in the tilting moment can be achieved during the closing process since force is introduced in an almost linear manner.

Preferably, the centering rails 25 are formed to extend (taper) towards the end in the direction of fire, as is clear from the plan view in FIG. 7. This extension region is referred to in the application and the claims as a (horizontal)

centering taper section 251, since horizontal self-centering of the barrel 1 is facilitated when the centering rails 25 come into contact with the recesses 15 in the barrel block 11. In this way, the self-centering of the barrel 1 can take place even in the event of a very rapid discharge, and this again facilitates the repeatability and precision.

Another preferred embodiment includes the regions 252 of the centering rails 25 which taper vertically, at least on one side, forwards in the direction of fire, as shown in FIG. 6. The region of the vertical taper of the centering rails 25 may also be referred to as a running in taper section 252 and is particularly preferably formed on either side; i.e. top and bottom, in the vertical direction in the direction of fire. At a rapid rate of fire, this measure also facilitates repeatable insertion of the centering rails 25 and helps reduce misfires.

Figure 6C:
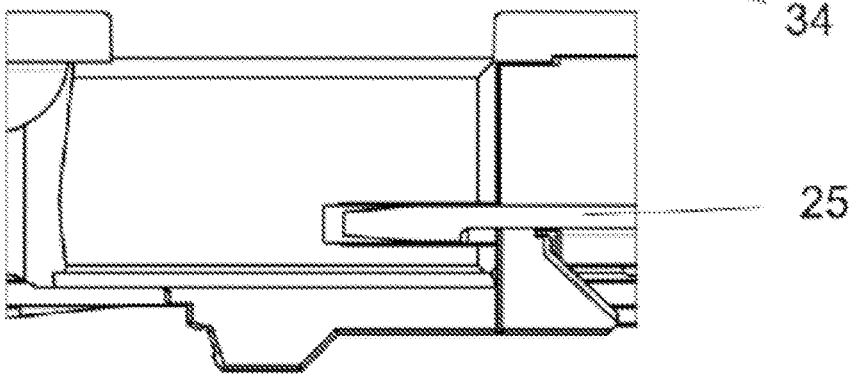

When the pistol is closed, as shown schematically in FIG. 6C, the barrel 1 is horizontally and/or vertically supported on the breech guide 21, as a result of which a muzzle-side support in the barrel opening 26 is not necessarily required. Furthermore, a support or rest for the socket protrusion 233 can be seen on the barrel block 11.

The breech face 231 also rests on the contact bars 16, as a result of which a further support and contact surface is formed between the barrel block 11 and the socket 23.

As can be seen from FIGS. 7A to 7C, the socket protrusions 233 can delimit the breech face 231 in the outward direction by forming breech face sidewalls 232 and can interact with the outer surfaces of the contact bars 161 in the closed state. During the closing process, the centering rails 25 are inserted into the recesses 15 and, in the example shown, the breech face sidewalls 232 are also used for supporting and laterally guiding the barrel block 11. FIG. 7C shows the situation just before the closing process is completed, in which it is clearly visible to a person skilled in the art that the barrel 1 is oriented largely by the interaction of the centering rails 25 according to the disclosure with the recesses 15 according to the disclosure by forming a contact and support pairing. Another, second contact pairing is formed by the socket protrusions 233 together with the surfaces that laterally outwardly adjoin the contact bars 16. As shown, a second contact pairing may preferably be formed between the contact bars 16 and the breech face 231. Furthermore, if the gap dimensions are suitably selected, a fourth support or contact of the socket protrusion 233 on the barrel block 11 can be formed in the barrel direction (FIG. 6C), The geometries can thus be easily adapted by a person skilled in the art in order to optimize the precision and durability of the pistol by means of the form and position of the recesses 15 relative to the centering rails 25. Furthermore, the second and/or third and/or fourth contact pairings can be adapted to one another in the vertical and/or horizontal direction, as described, in order to prevent any horizontal and/or vertical tilting of the barrel 1 due to the rear and/or lateral support relative to the socket 23. FIG. 8 is a section through FIG. 2C along line VIII-VIII, with the frame 3 comprising the recoil spring and the like not being shown for the sake of simplicity. This cross section is intended to illustrate a possible form of the guiding grooves 211 and the form-fitting receiving and/or connection of the breech guide 21 upwards to the slide frame 22, which is preferably made of plastics material, in particular a fiber-reinforced polymer, is produced. In comparison with FIGS. 3 and 4, it can be seen that the centering rails 25 can continue in the outer region and may be formed as mounting rails 27. In the selected view, the mounting rail 27 therefore coincides with the relevant centering rail 25 in the image direction as a lateral, substantially L-shaped protrusion. This construction in one piece allows the breech guide 21 to be designed to be very compact and lightweight, while having high functionality and a good connection of the slide frame 22.

In one particular embodiment, the locking block 37 is designed to receive and/or support the barrel hook 12 on its surface so as to be substantially complementary thereto in terms of form. Here, the surface of the locking block 37 is preferably designed such that, when viewed in the transverse direction, a trapezoidal recessed cross section is produced, which forms a vertical and also horizontal support together with the accordingly formed barrel hook 12.

The breech according to the present disclosure can, for example, be produced by means of machining methods such as milling, turning or grinding, and likewise the breech guide 21 and/or the barrel block 11 can be formed according to the present disclosure by shaping methods such as forging or hammering, powder metallurgy or MIM, or also by means of additive manufacturing methods such as 3D printing, or a combination of these methods.

The breech and/or pistol of the present disclosure is not limited to the embodiment that is shown and described, but can be modified and configured in several ways. In particular, the cross-sectional shapes of the above-mentioned rails, recesses, etc. can be adapted to the predetermined basic data, and the lengths and positions relative to the frame can also be adapted by a person skilled in the art without any difficulty with knowledge of the disclosure.

In the description and the claims, as already stated above, the terms "front", "rear", "above", "below", etc. are used in the generally accepted sense and with reference to the object in its normal position of use. This means that, for a weapon, the muzzle of the barrel is at the "front", that the breech and slide are moved to the "rear" by the explosive gases, etc. "Transverse to a direction" substantially means a direction rotated by 90° thereto.

It should also be noted that, in the description and the claims, statements such as "lower region" of an object means the lower half and in particular the lower quarter of the total height, "lowermost region" means the lowermost quarter and in particular an even smaller part, while "central region" means the central third of the total height. This applies, mutatis mutandis, to the terms "width" and "length". All of these statements have a generally accepted meaning, which is applied to the intended position of the object in question.

In the description and the claims, "substantially" means a deviation of up to 10% of the stated value, if it is physically possible, both down and up, and otherwise only in the relevant direction, and for stated degree values (angles and temperature), ±10° is thus meant. For terms such as "substantially constant" etc., the technical and not the mathematical deviation option which a person skilled in the art takes as a basis is meant. Therefore, a "substantially L-shaped cross section" has two elongated surfaces which each transition at one end into the end of the other surface, and the longitudinal extensions thereof are arranged at an angle of from 45° to 120°, preferably 80° to 100°, relative to one another.

Provided that they do not relate to the specific examples, all the stated amounts and proportions, in particular those for distinguishing the invention are to be understood with a tolerance of ±10%, thus, for example: 11% means from 9.9% to 12.1%. In terms such as "a solvent", the word "a" is not considered to be a quantifier, but rather an indefinite article or a pronoun if nothing to the contrary follows from the context.

Unless stated otherwise, the term "combination" or "combinations" means all types of combinations, ranging from two of the components in question through to a large number of components or all such components, and the term "containing" also covers "including" or "comprising".

The features and variants set out in the individual embodiments and examples can be combined with those of the other examples and embodiments in any manner, and can in particular be used for characterizing the invention in the claims without necessarily also incorporating the other details of the embodiment or example in question. In summary, it can be stated that the present disclosure relates to a breech for a pistol having a central weapon plane, comprising a barrel 1, which comprises at least one barrel block 11 and one chamber 12, a slide 2, comprising a breech guide 21, which is designed to move on a guide rail 31 of a frame 3 of the pistol and on which a socket 23 having a breech face 231 is formed, characterized in that the barrel block 11 comprises at least one recess 15 on each side, and centering rails 25 are formed on the inside of the breech guide 21 so as to be complementary to the recesses 15 in terms of form and function.

LIST OF REFERENCE SIGNS

| | |
|---|---|
| 1 | Barrel |
| 11 | Barrel block |
| 111 | Block side surface |
| 12 | Barrel hook |
| 13 | Chamber |
| 14 | Feed ramp |
| 15 | Centering recess |
| 16 | Contact bar |
| 161 | Contact bar side surface |
| 17 | Indication recess |
| 18 | Barrel axis |
| 2 | Slide |
| 21 | Breech guide |
| 211 | Guiding groove |
| 22 | Slide frame |
| 23 | Socket |
| 231 | Breech face |
| 232 | Breech face sidewall |
| 233 | Socket protrusion |
| 24 | Ejection window |
| 25 | Centering rail |
| 251 | Horizontal centering taper section |
| 252 | Vertical running in taper section |
| 26 | Barrel opening |
| 27 | Mounting rail |
| 28 | Slide stop |
| 29 | Spring bearing |
| 3 | Frame |
| 31 | Guide rails |
| 32 | Disassembly lever |
| 33 | Slide stop lever |
| 34 | Trigger |
| 35 | Magazine |
| 36 | Grip |
| 37 | Locking block |

The invention claimed is:

1. A breech for a pistol, the pistol having a frame and a central weapon plane, and the pistol being suitable for use with a magazine, the breech comprising:

a barrel having at least one barrel block and at least one chamber, where a cartridge feed ramp is formed at a rear end of the barrel block so that a cartridge can slide into the chamber from the magazine, and where the at least one barrel block includes at least one recess on each side of the barrel block; and a slide having a breech guide designed to move on a guide rail of the frame of the pistol, including a socket having a breech face formed on the slide;

wherein the breech guide includes centering rails on an inside of the breech guide, the centering rails being complementary to the recesses of the barrel block in terms of form and function.

2. The breech according to claim 1, wherein the recesses of the barrel block are arranged symmetrically with respect to the central weapon plane, and at a same level.

3. The breech according to claim 2, wherein the barrel defines a barrel axis, and the recesses of the barrel block are arranged at a level of the barrel axis.

4. The breech according to claim 1, wherein the centering rails each include a forward taper section in which at least one side of the centering rail tapers vertically in a direction of fire.

5. The breech according to claim 1, wherein the centering rails each include a forward taper section in which an inner side of the centering rail tapers horizontally in a direction of fire.

6. The breech according to claim 1, further comprising a pair of contact bars formed on the barrel block such that the contact bars project at least laterally from the chamber towards the breech face.

7. The breech according to claim 6, further comprising an indication recess formed between the contact bars in a direction of the chamber.

8. The breech according to claim 7, wherein the indication recess forms an oblique surface.

9. The breech according to claim 6, further comprising a pair of socket protrusions formed on the socket so as to project laterally from the breech face forwards in a direction of the barrel, such that inner surfaces of the socket protrusions are formed as breech face sidewalls and are flush with sidewalls of the contact bars.

10. The breech according to claim 9, wherein each socket protrusion (233), which is arranged laterally in a direction of an ejection window (24), includes a front surface that is inclined backwards laterally counter to a direction of the barrel.

11. The breech according to claim 1, wherein the breech guide includes mounting rails on an upper face of the breech guide, the mounting rails having a substantially L-shaped cross section projecting outwards.

12. A pistol having a central weapon plane and being suitable for use with a magazine, comprising:

a frame;

a barrel having at least one barrel block and at least one chamber, where a cartridge feed ramp is formed at a rear end of the barrel block so that a cartridge can slide into the chamber from the magazine, and where the at least one barrel block includes at least one recess on each side of the barrel block; and a slide having a breech guide designed to move on a guide rail of the frame, including a socket having a breech face formed on the slide;

wherein the breech guide includes centering rails on an inside of the breech guide, the centering rails being complementary to the recesses of the barrel block in terms of form and function.

13. The pistol according to claim 12, wherein the frame further includes a locking block that is substantially complementary in form on its surface to receive a barrel hook of the pistol.

14. The pistol according to claim 13, wherein the locking block has a trapezoidal cross section when viewed in a transverse direction.

15. The pistol according to claim 12, wherein the barrel is formed in one piece with the barrel block.

* * * * *